United States Patent [19]

Langer

[11] Patent Number: 4,550,642

[45] Date of Patent: Nov. 5, 1985

[54] FLUID PRESSURE OPERATED PISTON ENGINE ASSEMBLY

[75] Inventor: Alfred Langer, Norcross, Ga.

[73] Assignee: Nordson Corporation, Amherst, Ohio

[21] Appl. No.: 667,543

[22] Filed: Nov. 2, 1984

[51] Int. Cl.[4] ..... F01L 31/02

[52] U.S. Cl. ..... 91/346; 251/75

[58] Field of Search ..... 91/346; 251/75

[56] References Cited

U.S. PATENT DOCUMENTS

| | | | |
|---|---|---|---|
| 129,269 | 7/1872 | Clayton | 91/346 |
| 140,309 | 6/1873 | Rogers | 91/346 |
| 491,670 | 2/1893 | Vaughn | 91/346 |
| 549,117 | 11/1895 | Faulkner | 91/346 |
| 1,821,986 | 9/1931 | Plint | 91/346 |
| 1,880,650 | 10/1932 | Zagst | 91/346 |
| 2,073,809 | 3/1937 | Salentine | 91/346 |
| 3,514,226 | 5/1970 | Wood | 91/346 |
| 3,548,717 | 12/1970 | Passaggio | 91/346 |
| 3,606,590 | 9/1971 | Gebhardt et al. | 417/360 |

*Primary Examiner*—Paul E. Maslousky

*Attorney, Agent, or Firm*—Wood, Herron & Evans

[57] ABSTRACT

A fluid pressure operated piston engine assembly, such as a pump assembly, including a fluid pressure operated piston engine and a fluid valve for coupling fluid under pressure to alternative portions of the piston chamber of the piston engine. As disclosed, as the drive shaft of the piston engine approaches each end of its stroke, fluid under pressure is coupled by the fluid valve to a portion of the piston chamber to effect reversal of direction of travel of the drive shaft. The fluid valve includes a valve rod which is translated to effect the alternative modes of coupling pressurized fluid to the piston chamber. To accomplish this a drive frame is mounted for limited translation on the valve rod and driven by a pair of pins, attached to the piston engine drive shaft, at the ends of the drive shaft stroke. The drive frame carries a pair of flat springs having contoured portions bearing against a drive block attached to the valve rod, and as the drive shaft approaches each end of its stroke the pins engage the drive frame so that the springs co-act with the drive block to "snap" the valve rod to the alternative valve position.

2 Claims, 4 Drawing Figures

FLUID PRESSURE OPERATED PISTON ENGINE ASSEMBLY

DESCRIPTION OF THE INVENTION

This invention relates generally to a fluid pressure operated piston engine assembly. The invention more particularly concerns such an assembly including a fluid valve for coupling fluid under pressure to alternative portions of the piston chamber of the piston engine so that, as the drive shaft of the piston engine approaches each end of its stroke, fluid under pressure is coupled to a portion of the piston chamber to effect reversal of the direction of travel of the drive shaft.

In a fluid pressure operated piston engine, a pressurized fluid is used to reciprocate a piston and an attached drive shaft to perform mechanical work. To do this, a pressurized fluid valve is generally interposed between a source of pressurized fluid and the piston chamber of the piston engine to alternately pressurize and exhaust each end of the piston chamber. As the piston approaches an end of the chamber, and hence as the attached drive shaft approaches an end of its stroke, the valve must be actuated to effect reversal of the direction of travel of the piston and drive shaft.

Typically, in order to do this, some form of mechanical coupling is provided between the drive shaft and the pressurized fluid valve. One known form of fluid pressure operated piston engine, for example, is a pneumatically driven pump, such as may be used for pumping hot melt adhesive. In one form of such a pump, the pneumatic valve is a combined spool valve and poppet valve. The valve includes a valve element translatable within a valve housing to alternately couple pressurized air to each end of a piston chamber. The motion of the pump shaft is coupled to the valve element to translate the element when the pump shaft nears each end of its stroke in order to reverse the direction of travel of the pump shaft.

In one prior pump system of this type, a rocker arm cam mechanism including complicated coil spring assemblies was used. Such a system suffers from the problem of premature failure of components in the rocker arm cam mechanism. Further, because of tolerance variations, such a system requires that the mechanism be designed to effect reversal of the pump shaft prematurely in order to assure that there is no bottoming out of the piston in the air cylinder.

A number of other mechanisms have been employed in the past in fluid pressure operated piston engine assemblies for utilizing the piston engine drive shaft motion to operate a pressurized fluid valve. In one such mechanism a valve rod attached to the valve element carries a block having cam surfaces which are acted upon by a pair of spring biased rollers. The movement of the rollers is effected by the drive shaft movement. In this arrangement the drive shaft motion is coupled through a curved arm which imparts a rocking motion to the carrier of the spring biased rollers. This approach presents an alignment problem in maintaining the rollers in position relative to the valve rod.

In another prior mechanism of this type, the movement of the drive shaft at the ends of its stroke is imparted directly to the valve rod, with a separate spring biased mechanism operating on cam surfaces carried on a portion of the valve rod. This requires the use of one mechanical coupling between the drive shaft and the valve rod to move the valve rod, and a second mechanism with spring biased cam forces operating transversely to the valve rod to move the valve rod into each of its alternative positions and to maintain the valve rod in each such position.

Several other known mechanisms for coupling a fluid pressure operated piston engine drive shaft to a pressurized fluid valve element are either more complex than those discussed above or involve the interconnection of other system elements with one another. For example, in one system the piston of the piston engine is coupled to the valve element itself.

It is the general aim of the present invention to provide an improved fluid pressure operated piston engine assembly of the foregoing type which includes a pressurized fluid valve effectively cooperating with the piston engine to couple fluid under pressure to portions of the piston chamber to effect reversal of the direction of travel of the drive shaft as the drive shaft approaches each end of its stroke.

This objective has been accomplished in accordance with certain principles of the invention by providing, on a valve rod in such a system, a drive frame which includes means for forcibly urging the valve rod into each of its alternative positions, and wherein means are provided for directly coupling the piston engine drive shaft to the drive frame on the valve rod as the drive shaft approaches each end of its stroke.

In the form of the invention illustrated, the drive frame carries a pair of opposed flat springs disposed on opposite sides of the valve rod, with each spring having a V-shaped contoured portion. Each contoured portion has a first spring surface applying a force to the valve rod when the drive frame is in a first position relative to the valve rod, to forcibly urge the valve rod into a first position, and a second spring surface applying a force to the valve rod when the drive frame is in a second position relative to the valve rod, to forcibly urge the valve rod into a second position.

One basic advantage of the invention is that the drive frame for coupling the drive shaft motion to the valve rod is mounted for limited translation on the valve rod, thereby eliminating alignment problems. A further advantage of the invention, in the form disclosed, is the provision of a pair of flat springs carried by the drive frame on the valve rod, which cooperate to effect a strong "snap action" movement of the valve rod between its two alternative positions.

Another advantage of the disclosed form of the invention is the use of the translational movement of the drive shaft to directly produce translational movement of the drive frame on the valve rod.

Other objects and advantages of the invention, and the manner of their implementation, will become apparent upon reading the following detailed description and upon reference to the drawings, in which.

Figure 1:
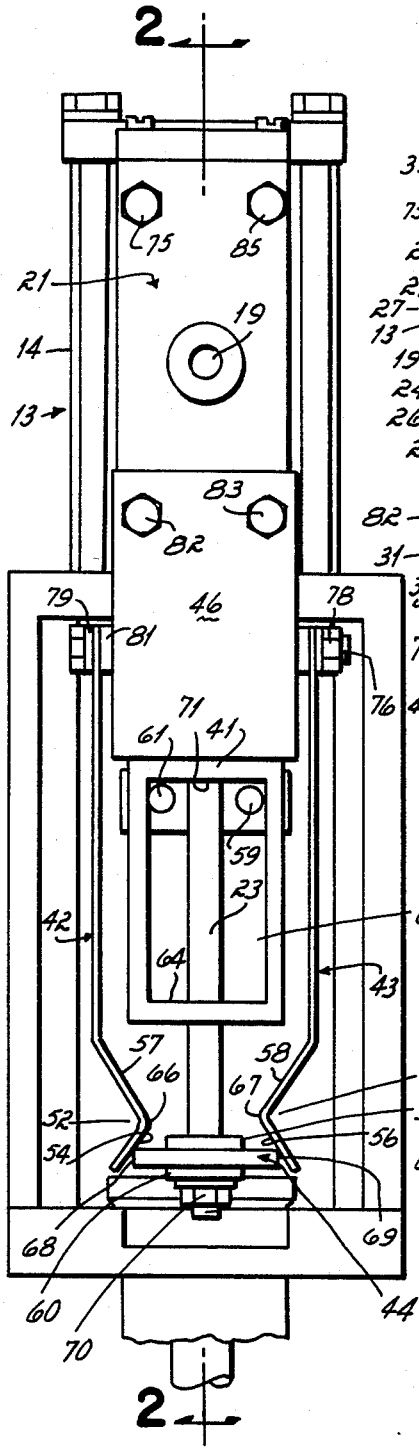
FIG. 1 is a front elevational view of a fluid pressure operated piston engine assembly in accordance with the present invention showing a first position of the valve rod.

While the invention is susceptible to various modifications and alternative forms, a specific embodiment thereof has been shown by way of example in the drawings and will herein be described in detail. It should be understood, however, that it is not intended to limit the invention to the particular form disclosed, but, on the contrary, the intention is to cover all modifications, equivalents, and alternatives falling within the spirit and scope of the invention as defined by the appended claims.

With reference now to the figures, a fluid pressure operated piston engine assembly includes a fluid pressure operated piston engine 12 and a fluid valve 13 for coupling fluid under pressure to the piston engine. The piston engine includes a housing 14 defining a piston chamber 16 in which a piston 17 reciprocates. Attached to, and reciprocable with, the piston 17 is a drive shaft 18. The drive shaft 18 may serve as a pump shaft, for example, if the piston engine 12 is employed as a pump.

The pressurized fluid valve 13, in the illustrated form, is a pneumatic valve for selectively coupling pressurized air from a pressurized air source (not shown) through an air inlet 19 to the piston chamber 16. The valve 13 includes a housing 21 fixedly secured to the piston engine housing 14. A valve spool 22, which serves as a flow-directing valve element, is translatable within the housing 21 and includes a valve rod 23 extending below the housing 21 generally parallel to the drive shaft 18.

Pressurized air communicates through the inlet 19 into an annulus 24 surrounding a reduced diameter portion of the spool 22. The pressurized air communicates from the annulus 24 through openings 26 into a bore 27 within the spool 22. The bore 27 communicates with openings 28, 29 at the top and bottom of the valve spool 22, respectively.

Figure 2:
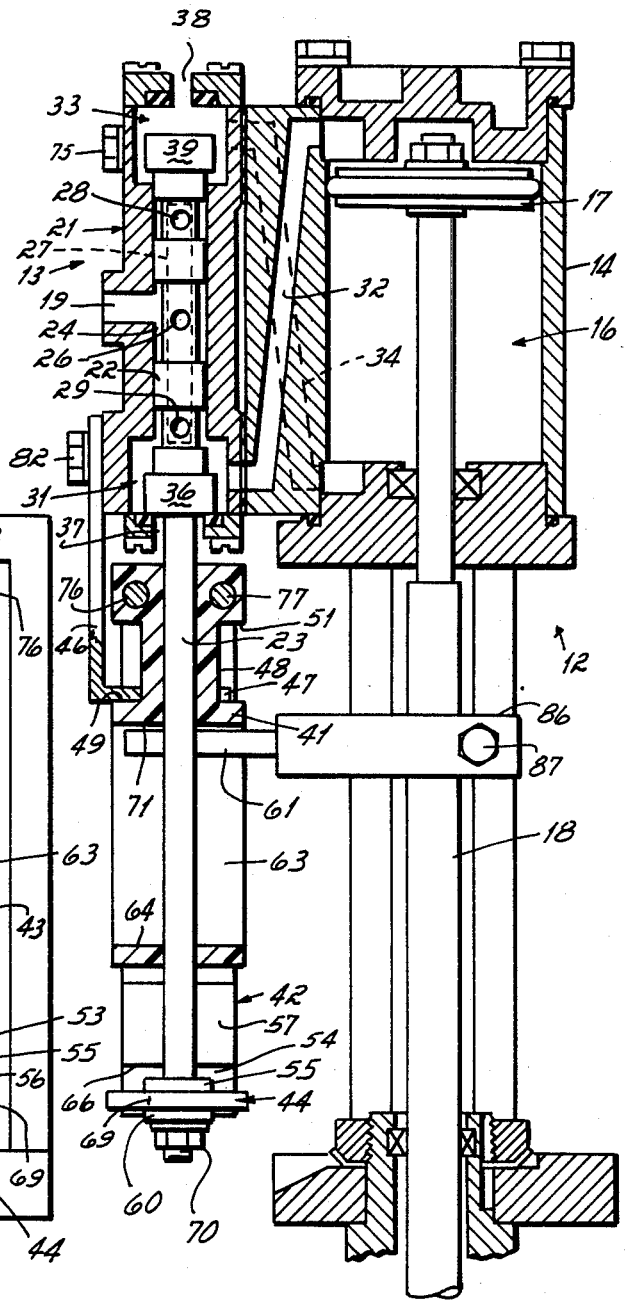
FIG. 2 is a side elevational view, partly in cross-section, of the assembly of FIG. 1.

With the valve spool 22 positioned as shown in FIG. 2, the pressurized air is coupled through the openings 29 to an annulus 31 around the valve spool and through a passageway 32 to the top of the piston chamber 16. When the spool 22 is in the position shown in FIG. 4, the pressurized air is coupled through the bore 27 to the openings 28, an annulus 33 surrounding the valve spool openings 28, and a bore 34 communicating with the bottom of the piston chamber 16.

Figure 4:
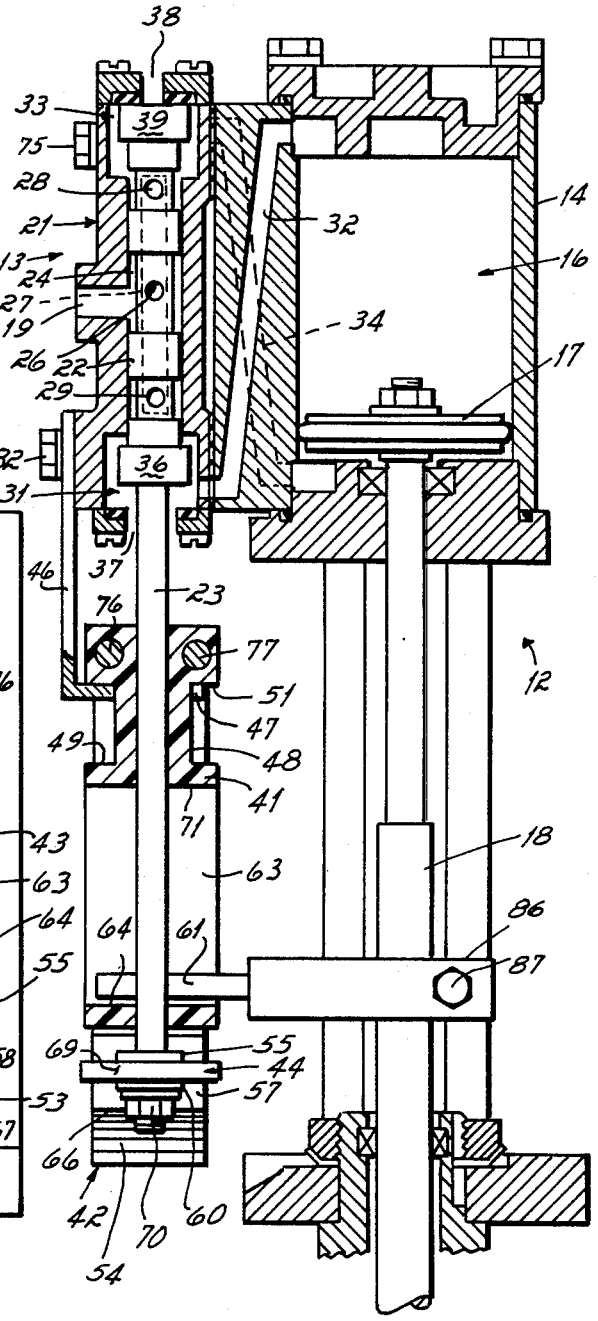
FIG. 4 is a side elevational view, partly in cross-section, of the assembly of FIG. 3.

With the spool 22 oriented as shown in FIG. 2, a plug portion 36 of the lower end of the spool closes off an opening 37 at the bottom of the valve housing 21. At this time, the passageway 34 is in communication with an opening 38 in the top of the valve housing 21 so that air may be vented from the bottom of the chamber 16 to the atmosphere as the piston 17 moves downwardly. Similarly, with the valve spool 22 positioned as shown in FIG. 4, air from the top of the chamber 16 communicates through the passageway 32 and the opening 37 to the atmosphere as the piston 17 moves upwardly. With the valve spool 22 in the position shown in FIG. 4, a plug portion 39 of the spool closes the opening 38 in the top of the valve housing 21, sealing the annulus 33 from the atmosphere.

In order to reciprocate the piston 17 and the drive shaft 18, and, for reference, referring initially to the positions of the valve spool 22 and piston 17 shown in FIG. 2, pressurized air is coupled through the inlet 19, the annulus 24, the openings 26, the bore 27, the openings 29, the annulus 31, and the passageway 32 to the upper portion of the piston chamber 16. The pressurized air acts upon the upper face of the piston 17, forcing the piston and the drive shaft 18 downwardly. As the piston 17 moves downwardly, the air in the lower portion of the chamber 16 is exhausted through the passageway 34 and the opening 38 in the top of the valve housing 21.

In a manner to be described hereinafter, when the piston 17 nears the bottom of the chamber 16, the valve spool 22 is moved upwardly to the position shown in FIG. 4. Pressurized air is then coupled through the valve 13 to the passageway 34 to act upon the lower face of the piston 17. The thus-applied force on the lower face of the piston 17 drives the piston back to the top of the chamber 16, whereupon the valve 13 is again activated. During the time that the piston 17 moves upwardly through the chamber 16, the air in the upper portion of the chamber is exhausted through the passageway 32 and the opening 37 in the bottom of the valve housing 21.

In order to activate the valve 13 as the piston 17 approaches the top and bottom of the chamber 16, and consequently as the drive shaft 18 approaches the ends of its stroke, the motion of the drive shaft is transmitted to the valve rod 23 via a drive frame 41 which is mounted for limited translation upon the valve rod. The drive frame 41 carries a pair of flat springs 42, 43 which engage a drive block 44 secured to the bottom of the valve rod 23, urging the valve rod either upwardly or downwardly. The drive frame 41 is normally in one of two stable positions relative to the valve rod 23, each of which is illustrated in the figures. In order to balance the spring forces exerted upon the drive block 44 in each of these two stable positions of the drive frame 41, a stop bracket 46 is secured to the valve housing 21. The stop bracket 46 includes a stop portion 47 surrounding a reduced cross section neck portion 48 forming the top of the drive frame 41.

When the springs 42, 43 on the drive frame engage the drive block 44 as shown in FIGS. 1 and 2, urging the drive block, the valve rod 23, and the valve spool 22 downwardly, the stop 47 bears against a surface 49 at the bottom of the neck 48 of the drive frame 41. This establishes one stable position for the drive frame wherein the force of the springs 42, 43 holding the valve spool 22 in its lower position within the valve housing 21 is balanced by the force exerted on the stop 47 by the surface 49.

Figure 3:
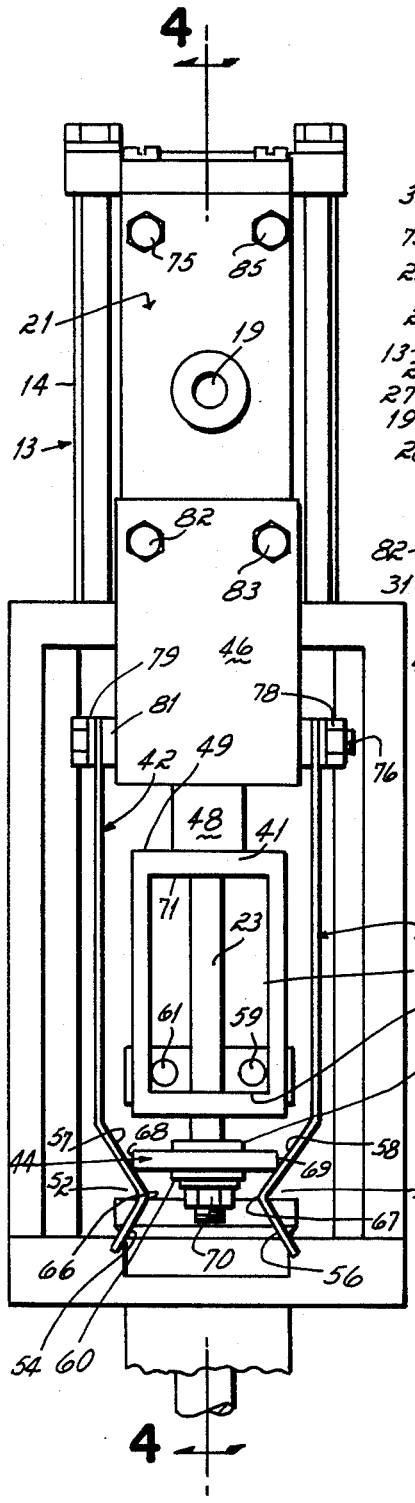
FIG. 3 is a front elevational view similar to that of FIG. 1 but showing the valve rod in its second position.

As shown in FIGS. 3 and 4, when the springs 42, 43 are positioned to urge the drive block 44, the valve rod 23, and the valve spool 22 upwardly, the stop 47 is engaged by a surface 51 at the top of the neck 48 of the drive frame.

To hold the valve rod 23 and the valve spool 22 in each of their two stable positions, the springs 42, 43 include contoured portions 52, 53, respectively. The contoured portions of the springs cooperate to form two pairs of opposed surfaces for forcibly urging the drive block 44 either upwardly or downwardly. As shown in FIGS. 1 and 2, when the drive block 44 is held in its downward position, the faces 54 and 56 of the springs 42, 43 are urged toward one another, resulting in a strong downward force on the drive block 44, the valve rod 23 and the valve spool 22. Similarly, as shown in FIGS. 3 and 4, when the drive block 44 is in its upward position, faces 57, 58 of the contoured portions of the flat springs are urged toward one another, engaging the drive block to produce a strong upward force on the drive block and the valve spool.

The drive block 44 is preferably of a material which is resistant to wear and which presents a low coefficient of friction to the springs 42, 43. One suitable material is a graphite-filled, Teflon-based, plastic such as Polycomp 185, supplied by LNP Corp. of Malvern, Pa. The drive block 44 is centrally apertured to receive the valve rod 23. The drive block 44 is mounted on the valve rod 23 sandwiched between suitable washers such as an upper washer 55 and a lower washer 60. The upper washer 55 abuts a shoulder (not shown) on the rod 23, and the washers and the drive block are secured in place against the shoulder. The lower end of the valve rod 23 is threaded, and the drive block is secured in place by a nut 70 received on the lower end of the valve rod.

The springs 42, 43 are secured to the drive frame 41 by a pair of bolts 76, 77 carried within bores through the upper portion of the drive frame. Each spring includes a pair of apertures receiving the bolts 76, 77, and the bolts are held in place by nuts such as 78. The springs are mounted upon the bolts between metal spacers such as 79, 81.

The stop bracket 46 is a generally L-shaped bracket mounted on the lower portion of the valve housing 21. The bracket 46 is secured to the housing 21 by pair of bolts 82, 83. The bolts 82, 83 also cooperate with bolts 75, 85 to secure the valve housing 21 to the piston engine housing 14.

In order to activate the valve 13 in coordination with the movement of the drive shaft 18, a pair of pins 59, 61 are clamped to the drive shaft and extend into a window 63 in the drive frame 41 below the drive frame neck 48. The pins 59, 61 are positioned along the drive shaft 18 so that they engage the drive frame 41 as the drive shaft approaches each end of its stroke. The pins 59, 61 are carried in a clamp 86 which is secured in place on the drive shaft 18 by a bolt 87.

As the drive shaft 18 and the piston 17 approach each end of a stroke, the pins 59, 61 engage the drive frame 41 to activate the valve to switch to its alternative valve spool position. For example, beginning, for reference, from the positions of the piston 17 and valve spool 22 shown in FIGS. 1 and 2, pressurized air is coupled to the upper portion of the piston chamber 16, applying a downward force to the piston. The piston 17 and the drive shaft 18 move downwardly under the influence of the pressurized air on the top of the piston 17, with the pins 59, 61 moving downwardly, unimpeded within the window 63 in the drive frame 41. While the pins move downwardly, the springs 42, 43 hold the drive block 44, the valve rod 23, and the valve spool 22 downwardly with the surface 49 of the drive frame bearing against the stop 47.

As the piston 17 approaches the bottom of the piston chamber 16, but before it has reached the fully downward position shown in FIG. 4, the pins 59, 61 engage a bottom surface 64 in the window 63 of the drive frame 41. The pins 59, 61 continue to move downwardly with the drive shaft 18 and urge the drive frame 41 and the springs 42, 43 downwardly from the position shown in FIG. 1. The contoured portions 52, 53 of the flat springs are then spread apart by the drive block 44 as the springs are forced downwardly until the innermost portions 66, 67 of the springs bear upon the lateral surfaces 68, 69 of the drive block. As the springs and drive frame are driven further downwardly by the pins 59, 61, the innermost portions 66, 67 of the springs move below the drive block surfaces 68, 69. At this time, the spring force of the flat springs 42, 43 drives the contoured portions 52, 53 of the springs together, driving the drive block 44 upwardly along the surfaces 57, 58 of the springs.

The upward movement of the drive block 44 carries the valve rod 23 and the valve spool 22 upwardly, moving the valve spool toward its alternative position as shown in FIGS. 3 and 4. As the springs 42, 43 move together, urging the drive block 44 upwardly, the springs and the drive frame 41 move downwardly until the surface 51 at the top of the neck 48 of the drive frame contacts the stop 47 on the bracket 46. This moves the bottom surface 64 of the window 63 of the drive frame 41 slightly below the pins 59, 61. Once the valve spool 22 (moved upwardly by the upward motion of the drive block 44) and the valve rod 23, reach the upward position (as shown in FIG. 4), the pressurized air is coupled to the bottom face of the piston 17, and the piston, the drive shaft 18, and the pins 59, 61 reverse their direction of travel and begin to move upwardly.

To complete one full cycle of operation, the pins 59, 61 move upwardly within the window 63 of the drive frame 41 as the piston 17 and the drive shaft 18 move upwardly. As the piston 17 approaches the top of the piston chamber 16, but before reaching the end position shown in FIG. 2, the pins engage a top surface 71 of the window 63 in the drive frame to begin moving the drive frame and the springs upwardly. Once again, the innermost portions 66, 67 of the contoured portions of the springs are urged apart onto the drive block lateral faces 68, 69. As the drive frame and springs are moved further upwardly by the pins 59, 61, the innermost portions 66, 67 of the springs move upwardly beyond the lateral surfaces of the drive block, and the drive block is received between the angled surfaces 54, 56 at the bottom of the springs.

The spring forces of the flat springs 42, 43 urge the surfaces 54, 56 toward one another, moving the drive block 44, the valve rod 23, and the valve spool 22 downwardly to their downward positions. Simultaneously, the springs 42, 43 and the drive frame 41 are moved upwardly until the surface 49 at the bottom of the neck 48 of the drive frame reaches the stop 47 of the bracket 46. The valve and drive frame are then returned to the positions illustrated in FIGS. 1 and 2. The switching of the valve spool position reverses the pressurized air connection to the piston chamber, reversing the direction of travel of the piston 17, the drive shaft 18, and the pins 59, 61, beginning another cycle of operation.

What is claimed is:

1. A fluid pressure operated piston engine assembly comprising:

a fluid pressure operated piston engine including a piston chamber, a piston reciprocable in the chamber, and a drive shaft attached to the piston and reciprocable therewith through a drive shaft stroke having a first end and a second end;

fluid valve means for coupling fluid under pressure to alternative portions of the piston chamber, including a valve rod translatable to (a) a first position in which the valve means is operable to couple fluid under pressure to a first portion of the piston chamber, tending to move the drive shaft toward the second end of its stroke and (b) a second position in which the valve means is operable to couple fluid under pressure to a second portion of the piston chamber, tending to move the drive shaft toward the first end of its stroke;

a drive frame, mounted for limited translation on the valve rod, including a pair of opposed flat springs disposed on opposite sides of the valve rod, each spring having a contoured portion with (a) a first spring surface applying a force to the valve rod when the drive frame is in a first position relative to the valve rod to forcibly urge the valve rod into its first position and (b) a second spring surface applying a force to the valve rod when the drive frame is in a second position relative to the valve rod to forcibly urge the valve rod into its second position; and means for (a) coupling the piston engine drive shaft to the drive frame as the drive shaft approaches the first end of its stroke so that the drive frame is moved to its first position relative to the valve rod and (b) coupling the piston engine drive shaft to the drive frame as the drive shaft approaches the second end of its stroke so that the drive frame is moved to its second position relative to the valve rod, whereby, as the drive shaft approaches its end of its stroke, fluid under pressure is coupled to a portion of the piston chamber to effect reversal of the direction of travel of the drive shaft.

2. A fluid pressure operated piston engine assembly comprising:

a fluid pressure operated piston engine including a piston chamber, a piston reciprocable in the chamber, and a drive shaft attached to the piston and reciprocable therewith through a drive shaft stroke having a first end and a second end;

a fluid valve assembly for coupling fluid under pressure to alternative portions of the piston chamber including a valve housing fixedly mounted with respect to the piston chamber, a valve element translatable in the valve housing, and a valve rod attached to the valve element, the valve rod and valve element being translatable to (a) a first position in which the valve assembly is operable to couple fluid under pressure through the valve element to a first portion of the piston chamber, tending to move the drive shaft toward the second end of its stroke and (b) a second position in which the valve assembly is operable to couple fluid under pressure to a second portion of the piston chamber, tending to move the drive shaft toward the first end of its stroke;

a drive frame, mounted for limited translation on the valve rod, having an opening generally facing the piston engine drive shaft;

a drive block mounted on the valve rod and extending laterally beyond the valve rod, the drive block being secured to the valve rod such that the drive frame is received on the valve rod between the drive block and the valve housing;

a pair of opposed flat springs attached to the drive frame and extending generally parallel to the valve rod and disposed on opposite sides thereof, each spring having a contoured portion with (a) a first spring surface applying a force to the drive block when the drive frame is in a first position relative to the valve rod to forcibly urge the valve rod into its first position and (b) a second spring surface applying a force to the drive block when the drive frame is in a second position relative to the valve rod to forcibly urge the valve rod into its second position;

a mechanical stop element attached to the valve housing including a portion contacting the drive frame when it is in either its first or second position relative to the valve rod; and a force-transmitting element attached to the piston engine drive shaft and having a portion extending into the opening in the drive frame so that the force-transmitting element contacts the drive frame as the drive shaft approaches the first end of its stroke to move the drive frame to its first position relative to the valve rod and (b) contacts the drive frame as the drive shaft approaches the second end of its stroke to move the drive frame to its second position relative to the valve rod, whereby, as the drive shaft approaches each end of its stroke, fluid under pressure is coupled to a portion of the piston chamber to effect reversal of the direction of travel of the drive shaft.

* * * * *